US010391661B2

(12) United States Patent
Jakob

(10) Patent No.: US 10,391,661 B2
(45) Date of Patent: Aug. 27, 2019

(54) METHOD AND DEVICE FOR BREAKING OUT A PLANAR WORKPIECE FROM A MATERIAL SHEET

(71) Applicant: Joachim Jakob, Radolfzell (DE)

(72) Inventor: Joachim Jakob, Radolfzell (DE)

(73) Assignee: Boxplan GmbH & Co. KG, Radolfzell (DE)

( * ) Notice: Subject to any disclaimer, the term of this patent is extended or adjusted under 35 U.S.C. 154(b) by 0 days.

(21) Appl. No.: 15/498,928

(22) Filed: Apr. 27, 2017

(65) Prior Publication Data

US 2018/0169884 A1 Jun. 21, 2018

(30) Foreign Application Priority Data

Dec. 19, 2016 (DE) ..... 10 2016 124 848
Mar. 15, 2017 (DE) ..... 10 2017 105 508

(51) Int. Cl.
*B26D 7/18* (2006.01)
*B26F 1/44* (2006.01)

(52) U.S. Cl.
CPC ..... *B26D 7/1818* (2013.01); *B26D 2007/189* (2013.01); *B26D 2007/1881* (2013.01); *B26F 1/44* (2013.01); *Y10T 225/371* (2015.04); *Y10T 225/379* (2015.04)

(58) Field of Classification Search
CPC .... B26F 3/00; B26F 3/002; B26F 1/44; Y10T 225/371; Y10T 225/379; B26D 7/1818; B26D 2007/189; B26D 2007/1881
See application file for complete search history.

(56) References Cited

U.S. PATENT DOCUMENTS 5,181,640 A * 1/1993 Vossen ..... B26D 7/1818 225/93
6,102,268 A * 8/2000 Raveleau ..... B26D 7/1818 225/103
6,997,363 B1 * 2/2006 Vossen ..... B26D 7/1818 225/103

FOREIGN PATENT DOCUMENTS

DE 4122005 A1 1/1993
DE 69701218 T2 9/2000
FR 3044248 A1 * 6/2017

OTHER PUBLICATIONS

German examination report for patent application No. 10 2017 105 508.8 dated Oct. 18, 2017.

* cited by examiner

*Primary Examiner* — Stephen Choi
(74) *Attorney, Agent, or Firm* — Bachman & LaPointe, PC

(57) ABSTRACT

In a device for breaking out a workpiece (3) from a material sheet (2) through an opening (4) of a die (1) by means of a breakout tool (5), the die (1) is to have a plug-in unit (22), wherein a breakout module (9.1-9.4) is insertable into the plug-in unit (22), wherein the breakout module (9.1-9.4) is composed of an insert (10) and of a module lobe (11), wherein the insert (10) has a surface (16) and a shearing edge (17), wherein the shearing edge (17) toward a bearing face (12) of the module lobe (11) configures an offcut length (18), and wherein the offcut length has a height (h) of 0.8 mm to 1.8 mm, and preferably of 1.5 mm.

10 Claims, 2 Drawing Sheets

METHOD AND DEVICE FOR BREAKING OUT A PLANAR WORKPIECE FROM A MATERIAL SHEET

BACKGROUND OF THE INVENTION

The invention relates to a device for breaking out a planar workpiece.

In punching technology it is known for offcuts or blanks to be punched from a material sheet. If this is done from comparatively thin sheets such as, for example, paper, cardboard, paperboard, corrugated cardboard, plastics, or even wood, this is referred to as breaking out. As opposed to punching, in the case of breaking out there are already preformed rupture lines such that the respective offcut or blank, respectively, has only to be impinged with pressure in order for the former to break out of the material sheet. The impingement with pressure herein is performed by a breakout tool which for example by way of corresponding pins or strips, respectively, pushes onto the offcut/blank. Henceforth, offcuts and blanks, irrespective of type, and any other items which can be broken out of a material sheet, will be referred to as a workpiece.

Breaking out is typically performed above an opening of a die, wherein the workpiece then can make its way downward through this opening and be discharged. A device of this type for breaking out from a material sheet is known from WO 2011/098300 A. However, it has been demonstrated in practice that jamming or canting of the workpieces in the opening often arises, leading to a malfunction in the entire method sequence.

SUMMARY OF THE INVENTION

It is an object of the present invention to eliminate the disadvantages of the prior art and to develop a device and a method of the type mentioned above in which a sequence of the breaking-out procedure with as few malfunctions as possible can be guaranteed.

The features disclosed herein lead to the object being achieved.

This presently is thus a device for breaking out a planar workpiece from a material sheet through an opening of a die by means of a breakout tool, wherein the die has a plug-in unit, wherein a breakout module is insertable into the plug-in unit, wherein the breakout module is composed of an insert and of a module lobe, wherein the insert has a surface and a shearing edge, wherein the shearing edge toward a bearing face of the module lobe configures an offcut length, and wherein the offcut length has a height of 0.8 mm to 1.8 mm, and preferably of 1.5 mm.

It is advantageous here that complex joinery work such as have been necessary in the prior art for setting the die can be omitted by way of the interchangeability of the breakout module in the plug-in unit. Moreover, breakout modules from dissimilar materials and hardness grades can be used in a simple manner by way of the interchangeability of the breakout module.

The breakout module furthermore reduces an available width of the opening of the die. At least two breakout modules are preferably provided in the opening, wherein the former are in each case mutually opposite. If more than two breakout modules are provided, two breakout modules are thus always mutually opposite.

The module lobe is at least partially resilient in relation to the insert, and is made from plastics. Said module lobe has a beveled and/or rounded sliding face. The module lobe opposite the bearing face configures a collar which leads into a main body of the insert.

The breakout tool has breakout pins or breakout strips by way of which the workpiece is impingeable with pressure.

As has already been described above, in the use position of a breakout module the surface of the insert of the breakout module terminates flush with a depositing face of the die, or lies in the plane of the depositing face, respectively. A bearing face and the module lobe of the breakout module adhere to a spacing of approximately 1.5 mm from the surface of the insert, or the depositing face of the die, respectively. This is necessary in order for the workpiece to be able to lie on the module lobe once the former has been broken out of the material sheet.

It has also proven advisable for the breakout module to likewise have beveled and/or rounded sliding face that in the use position is directed toward the opening. Said sliding face facilitates impressing of the workpiece between the breakout modules, or else bending of the workpiece.

A breakout module is inserted into the plug-in unit of a side wall of the opening in the die. There are presently preferably four breakout modules, wherein in each case two breakout modules are inserted into mutually opposite plug-in units of the side walls of the opening of the die. Of course, as has already been described above, there may also be more or fewer breakout modules which are inserted into plug-in units in the side wall of the opening. However, the number of four breakout modules has proven advantageous. It is thus guaranteed that compression forces which, as will be described hereunder, lead to bending of the workpiece are applied uniformly to lateral edges of the workpiece.

The number of breakout modules is largely determined by the size and shape of the offcut. It applies herein that at least two breakout modules have any effect whatsoever. It is ideal for said breakout modules to then be mutually opposite, as has already been explained above. However, this is not always possible if there is an odd number of breakout modules. The arrangement is then determined by the size and shape of the off cut.

By repositioning the breakout tool toward the die, the workpiece on defined breakout lines in a first step with the aid of the breakout pins or breakout strips is separated from the remaining workpiece sheet. In a second step, the workpiece is pushed onto the bearing faces of the module lobes. In a third step, the workpiece by way of an increase in the compressive force of the breakout tool is pushed past the breakout modules in a defined direction. The module lobes herein can be compressed in a corresponding manner, in order for the opening width (spacing between two breakout modules) to be widened, so that an increased counter-pressure between the offcut and the breakout pins/strips is reduced. A comparatively thick or resistant material/workpiece, respectively, can otherwise impede the breakout procedure. Bending of the workpiece can also arise herein so that said workpiece can make its way through the reduced opening width. As soon as said reduction of the opening width is terminated, the workpiece in a centrifugal effect is ejected downward, if and when the breakout procedure takes place in a downward manner.

There are of course also workpieces which have a comparatively great thickness or else a comparatively high hardness, for example, such that bending if at all can take place to only a very minor extent. It is provided in this case that the module lobe of the breakout module buckles once and thereafter remains in this position for all subsequent workpieces. It is not provided that the action of the breakout module is designed so as to be sprung. Nevertheless, it is to be provided that the module lobe is to be designed so as to be comparatively resilient.

Buckling, or the resilience, respectively, has the effect that the workpiece can be pushed through between the breakout modules, but that the latter, after the workpiece having been pushed through, likewise apply a centrifugal effect to the workpiece.

The breakout tool is preferably provided with corresponding means for breaking out the workpieces from the sheet. Said means are in most instances breakout pins or breakout strips. It is singularly essential that the workpiece is impingeable with pressure and that controlled bending of the workpiece is allowed.

BRIEF DESCRIPTION OF THE DRAWINGS

Further advantages, features, and details of the invention are derived from the description hereunder of preferred exemplary embodiments, and by means of the drawing in which.

DETAILED DESCRIPTION

Figure 1A:
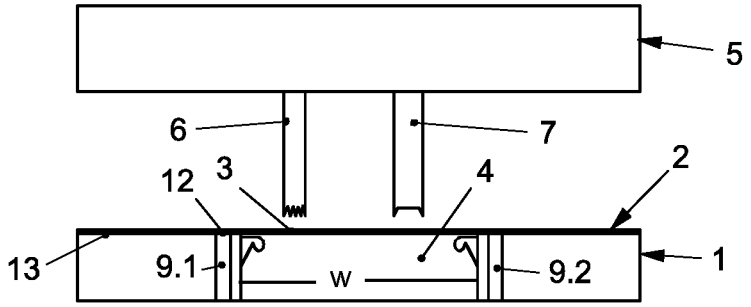
FIGS. 1*a*, 1*b*, 1*c* and 1*d* shows a sequence diagram of the method according to the invention for breaking out a workpiece.

A die 1 can be seen in FIG. 1, a planar material of a material sheet 2 to be processed bearing on said die 1. For example, said material sheet 2 can be composed of paper, cardboard, corrugated cardboard, wood, plastics, or the like. A workpiece 3 is to be broken out of this material sheet 2, specifically in the context of an opening 4 in the die 1. A breakout tool 5 is provided to this end.

The workpiece 3 can be an offcut or else a blank, that is to say, for example, a blank for a folding box, a part of a printing sheet, of a utility or consumer product, or the like. Many possibilities are conceivable here, all of which are in the scope of the invention.

Figure 2:
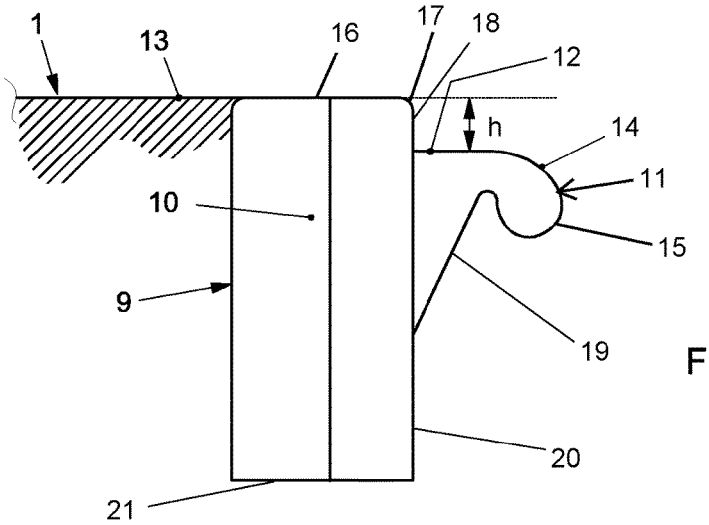
FIG. 2 shows a side view of a breakout module according to the invention.
Figure 3:
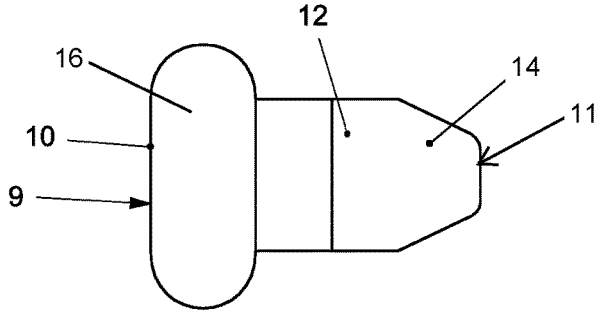
FIG. 3 shows a plan view of the breakout module in FIG. 2.
Figure 4:
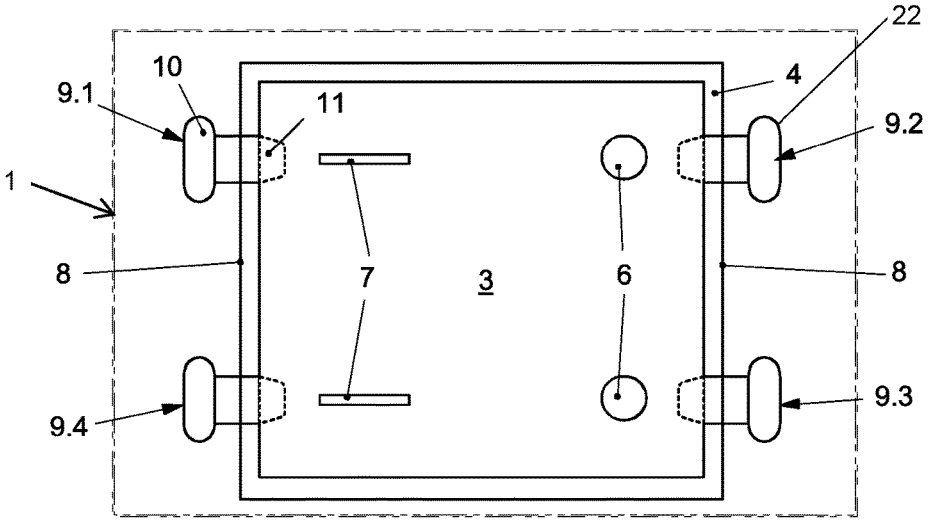
FIG. 4 shows a plan view of part of a lower breakout tool of a device according to the invention for breaking out a workpiece.

As is illustrated in FIG. 4, breakout modules 9.1 to 9.4 which are composed substantially of an insert 10 and a module lobe 11 are inserted into plug-in units 22 in side walls 8 of the opening 4 in the die 1. Said breakout modules 9.1 to 9.4 are illustrated in an enlarged manner in FIGS. 2 and 3.

The insert 10 in the use position of the breakout modules 9.1 to 9.4 has a surface 16 and a shearing edge 17, wherein the shearing edge 17 toward a bearing face 12 of the module lobe 11 configures an offcut length 18, and wherein the offcut length has a height h of 0.8 mm to 1.8 mm, and particularly preferably of 1.5 mm. In other words, the surfaces 16 of the inserts 10 of the breakout modules 9.1 to 9.4 thus terminate flush with a depositing face 13 of the die 1, or lie in the plane of the depositing face 13, respectively. The bearing faces 12 and the module lobes 11 of the breakout modules 9.1 to 9.4 adhere to a spacing from the surfaces 16 of the inserts 10, or from the depositing face 13 of the die 1, respectively, of in each case approximately 0.8 mm to 1.8 mm, and particularly preferably 1.5 mm, so that the workpiece 3 after breaking out can first be deposited on said bearing faces 12 and said module lobes 11.

The module lobe 11 opposite the bearing face 12 has a collar 19 which leads into a main body 20 of the insert 10. The main body 20 in turn transitions into a surface 21 which is disposed so as to be substantially parallel with the surface 16.

The operating mode of the present invention will be explained in more detail by means of FIG. 1. According to FIG. 1*a*, the material sheet 2 having the workpiece 3 to be broken out is located on the depositing face 13 of the die 1. The opening 4 of the die 1 is obscured by the material sheet 2. The breakout tool 5 having breakout pins 6 or breakout strips 7, respectively, is located above the material sheet 2.

Figure 1B:
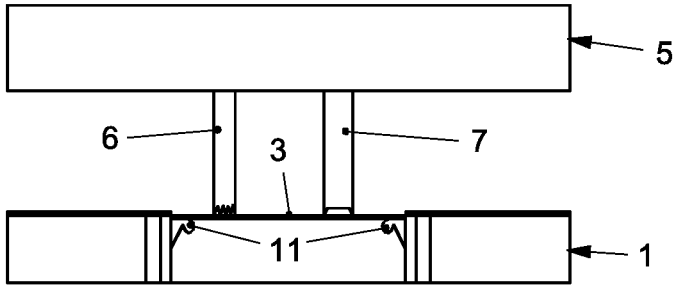
Figure 1C:
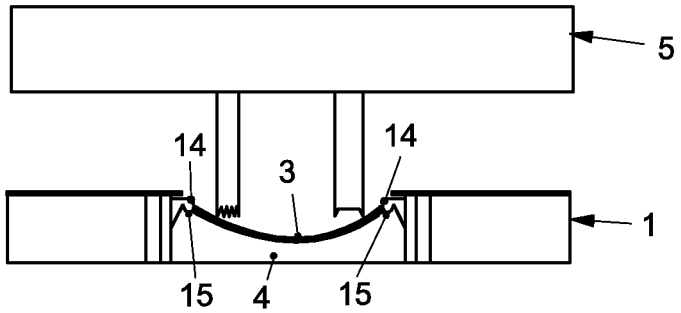

According to FIG. 1*b*, the breakout tool 5 is now lowered such that the breakout pins 6 or breakout strips 7, respectively, can break the workpiece 3 out of the material sheet 2. The workpiece 3 then bears on the module lobes 11 of the breakout modules 9.1 to 9.4.

In the case of the breakout tool 5 being lowered further, the workpiece 3 is pushed over oblique or rounded sliding faces 14, respectively, of the module lobes 11, wherein the workpiece 3 is compressed in a concave manner. This is to say that the workpiece 3 bulges in a direction that faces away from the breakout tool 5, and thus in the direction of pressure. Bending of the workpiece 3 arises by way of this constriction so that said workpiece 3 can be pushed through the constriction of the available width w of the opening 4, as will be described hereunder.

As soon as the workpiece 3 has reached a lower end 15 of the module lobes 11, the tension which has been generated by the bending of the workpiece 3 is cancelled, since the opening 4 henceforth is sufficiently wide again. Said cancellation of the tension arises abruptly, however, such that the workpiece 3 is ejected downward.

Figure 1D:
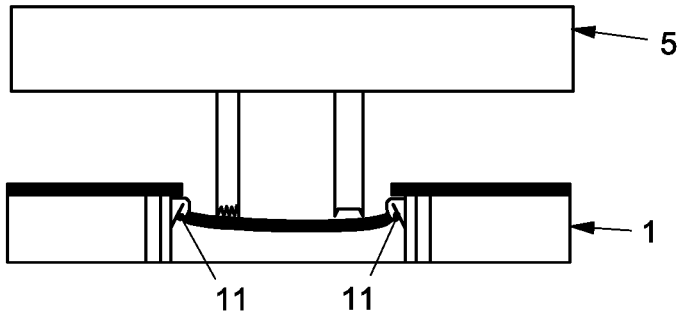

It is indicated in FIG. 1*d* that the module lobes 11 in the case of workpieces from a comparatively hard or thick material, which on account thereof allow no or only minor bending, are designed so as to be resilient. However, said resilience has a similar centrifugal effect as has been described above in the context of the comparatively resilient workpieces 3 in FIG. 1*c*.

The breakout tool 5 presently can operate at two pressure stages. The workpiece 3 is separated from the material sheet 2 in a first pressure stage. The pressure of the breakout tool 5 is subsequently increased, in order for the workpiece 3 to be guided as fast as possible past the module lobes 11.

The workpiece 3 is indicated as being within the opening 4 in FIG. 4. The plug-in units 22 are located laterally in the side walls 8 of the respective breakout modules 9.1 to 9.4. The breakout pins 6 and breakout strips 7 are also indicated.

While only one preferred exemplary embodiment of the invention has been described and illustrated it is obvious to a person skilled in the art that numerous modifications can be added without departing from the concept and the scope of the invention.

The invention claimed is:

1. Device for breaking out a workpiece (3) from a material sheet (2) through an opening (4) of a die (1) by means of a breakout tool (5), wherein the die (1) has a plug-in unit (22), wherein a breakout module (9.1-9.4) is insertable into the plug-in unit (22), wherein the breakout module (9.1-9.4) is composed of an insert (10) and of a module lobe (11) having a bearing face (12) for receiving the workpiece (3) after breaking out, wherein the insert (10) has a surface (16) and a shearing edge (17), wherein the shearing edge (17) faces toward the bearing face (12) and an offcut surface extending from the shearing edge (17) to the bearing face (12) and defining an offcut length (18), and wherein the offcut length has a height (h) from the surface (16) to the bearing face (12) of 0.8 mm to 1.8 mm, and wherein the module lobe (11) is at least partially resilient.

2. Device according to claim 1, wherein the height (h) is 1.5 mm.

3. Device according to claim 1, wherein the breakout module (9.1-9.4) which reduces an available width (w) of the opening (4) is disposed in the opening (4).

4. Device according to claim 1, wherein at least two breakout modules (9.1-9.4) are provided in the opening (4), wherein the breakout modules (9.1-9.4) are mutually opposite.

5. Device according to at least claim 1, wherein the module lobe (11) has a beveled and/or rounded sliding face (14).

6. Device according to claim 1, wherein the module lobe (11) opposite the bearing face (12) configures a collar (19) which leads into a main body (20) of the insert (10).

7. Device according to claim 1, wherein the breakout tool (5) has breakout pins (6) or breakout strips (7) by way of which the workpiece (3) is impingeable with pressure.

8. Device according to claim 1, wherein the module lobe (11) defines an upwardly facing rounded sliding face which is convex toward the workpiece (3).

9. Device according to claim 1, wherein the offcut surface is a substantially vertical side surface connecting the surface (16) and the bearing face (12).

10. Device according to claim 9, wherein the offcut surface is connected to the surface (16) through the shearing edge (17).

* * * * *